US011390824B2

(12) United States Patent
Wang et al.

(10) Patent No.: US 11,390,824 B2
(45) Date of Patent: Jul. 19, 2022

(54) COMPOSITIONS FOR USE AS LUBRICANTS IN DIE CASTING, METHODS OF USING THE SAME, AND PRODUCTS PRODUCED THEREWITH

(71) Applicant: PURDUE RESEARCH FOUNDATION, West Lafayette, IN (US)

(72) Inventors: Xiaoming Wang, West Lafayette, IN (US); Qingyou Han, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 51 days.

(21) Appl. No.: 16/965,645

(22) PCT Filed: Jan. 28, 2019

(86) PCT No.: PCT/US2019/015342
§ 371 (c)(1),
(2) Date: Jul. 29, 2020

(87) PCT Pub. No.: WO2019/148066
PCT Pub. Date: Aug. 1, 2019

(65) Prior Publication Data

US 2021/0040409 A1 Feb. 11, 2021

Related U.S. Application Data

(60) Provisional application No. 62/623,115, filed on Jan. 29, 2018.

(51) Int. Cl.
*B22D 17/00* (2006.01)
*C10M 125/26* (2006.01)
(Continued)

(52) U.S. Cl.
CPC ..... *C10M 125/26* (2013.01); *B22C 3/00* (2013.01); *B22D 17/2007* (2013.01);
(Continued)

(58) Field of Classification Search
CPC ..... C10M 125/26; C10M 125/18; C10M 169/04; C10M 2201/06; C10M 2201/081;
(Continued)

(56) References Cited

U.S. PATENT DOCUMENTS 4,766,948 A * 8/1988 Behr ..... B22C 3/00 106/38.22
5,302,450 A 4/1994 Rao et al.
(Continued)

FOREIGN PATENT DOCUMENTS

EP 1431377 6/2004

OTHER PUBLICATIONS

International Search Report and Written Opinion for International Application No. PCT/US2019/015342, dated May 10, 2019 (13 pages).

*Primary Examiner* — Prem G Singh
*Assistant Examiner* — Francis C Campanell
(74) *Attorney, Agent, or Firm* — Hartman Global IP Law; Gary M. Hartman; Domenica N. S. Hartman

(57) ABSTRACT

Lubricant compositions and methods of producing die-cast products by applying such a lubricant composition to a working surface of a die prior to casting a product from a molten metal injected into the die. The composition serves as lubricant between the die and resulting product, and contains at least one active component that reacts with an oxide of the metal to remove a layer of the oxide that forms on a surface of the melt during the die casting process.

14 Claims, 2 Drawing Sheets

(51) Int. Cl.

| | |
|---|---|
| ***B22C 3/00*** | (2006.01) |
| ***B22D 17/20*** | (2006.01) |
| ***C10M 125/18*** | (2006.01) |
| ***C10M 169/04*** | (2006.01) |
| ***C22F 1/04*** | (2006.01) |
| *C10N 40/20* | (2006.01) |

(52) U.S. Cl.
CPC ..... *C10M 125/18* (2013.01); *C10M 169/04* (2013.01); *C22F 1/04* (2013.01); *C10M 2201/06* (2013.01); *C10N 2040/242* (2020.05)

(58) Field of Classification Search
CPC . C10M 2201/087; C10M 161/00; B22C 3/00; B22D 17/2007; C22F 1/04; C10N 2040/242; C10N 2020/06; C10N 2040/24; C10N 2050/02
USPC ..... 148/538
See application file for complete search history.

(56) References Cited

U.S. PATENT DOCUMENTS

| | | | |
|---|---|---|---|
| 5,913,353 | A | 6/1999 | Riley et al. |
| 2005/0000672 | A1 | 1/2005 | Ban et al. |
| 2005/0043189 | A1 | 2/2005 | Stewart et al. |

* cited by examiner

COMPOSITIONS FOR USE AS LUBRICANTS IN DIE CASTING, METHODS OF USING THE SAME, AND PRODUCTS PRODUCED THEREWITH

CROSS REFERENCE TO RELATED APPLICATIONS

This application claims priority to International Patent Application No. PCT/US2019/015342, filed Jan. 28, 2019, which claims the benefit of U.S. Provisional Application No. 62/623,115 filed Jan. 29, 2018. The contents of these prior applications are incorporated herein by reference.

BACKGROUND OF THE INVENTION

The present invention generally relates to die casting. The invention particularly relates to lubricants applied to working surfaces of dies prior to casting.

Die casting is used routinely for the mass production of many metallic components of complex shapes. Metals commonly used for die casting include zinc, magnesium, aluminum, and their respective alloys. During these processes, high pressures and temperatures are used to inject a liquid metal (melt) into the cavity of a die, often though not necessarily a steel die. To protect metal dies from reactions with or degradation from the melt and to extend the service lives of dies, die lubricants (also referred to as die release fluids) are routinely sprayed onto working surfaces of the dies (e.g., surfaces contacted by the melt during casting) prior to and between casting cycles. Commercially available die lubricants well known in the art are typically oil-based or water-based.

The presence of a lubricant on working surfaces of a die can cause problems during a die casting process. For example, conventional die lubricants may leave residues on surfaces of dies after one or more casting cycles that must be removed, leading to reduced up time and decreased productivity. In addition, conventional die lubricants commonly produce a relatively large amount of gas due to evaporation of the lubricant. This increase in gas within a die tends to form undesirable inclusions and porosity in die-cast products, which may lead to increased scrap rates and/or premature failure of the products. Moreover, the presence of inclusions and porosity may result in die-cast products being unsuitable for subsequent heat treatments (e.g., age hardening). For example, inclusions and porosity can deteriorate a die-cast product during heating by forming, for example, microcracks and/or blistering. Such die-cast products have limited ductilities that are too low for certain critical or demanding structural applications, as nonlimiting examples, the front cross members and front control arms of passenger cars.

Efforts have been made to overcome gas production during die casting by utilizing higher injection temperatures and higher pressures in order to achieve higher injection rates and improved die filling (i.e., overcome poor fluidity of a melt). However, increasing the temperature and pressure of casting results in increased die wear and a reduced die service life, leading to increased costs. Other methods attempted, particularly for aluminum die-cast products, involve reducing the iron content of the melt. However, lowering the iron content of an aluminum alloy accelerates reactions between the melt and a steel die, leading to a decrease in die service life. As the demand for heat treatable die-cast products increases, the alloys used in die casting have a reduced tolerance for impurities, such as iron. This, in combination with the addition of other alloying elements, makes die casting more difficult due to a reduced fluidity of the melt.

In view of the above, it can be appreciated that there is an ongoing demand for die lubricants that are capable of promoting improved die filling while reducing the likelihood of the formation of inclusions and porosity, resulting in die-cast products that are more likely to be heat treatable.

BRIEF DESCRIPTION OF THE INVENTION

The present invention provides lubricant compositions and die casting methods capable of producing die-cast products characterized by reduced inclusions and porosity relative to die-cast products produced with the use of conventional die lubricants.

According to one aspect of the invention, a lubricant composition is provided for coating working surfaces of a die that is contacted with a melt containing a molten metal during a die casting process. The composition includes a carrier fluid and at least one active component that reacts with an oxide of the metal to remove a layer of the oxide that forms on a surface of the melt.

According to another aspect of the invention, a method of producing a die-cast product includes providing a die for casting a melt containing a molten metal, coating working surfaces of the die with a lubricant composition containing at least one active component, injecting a quantity of the melt into the die such that the melt contacts the working surfaces and the at least one active component reacts with an oxide of the metal to remove a layer of the oxide that forms on a surface of the melt, and solidifying the melt in the die to yield the die-cast product.

Other aspects of the invention include die-cast products produced with the lubricant composition and method described above.

Technical effects of the lubricant composition and method described above preferably include the ability to produce die-cast products with reduced inclusions and porosity relative to die-cast products produced with conventional lubricants, and are therefore capable of undergoing subsequent heat treatments to modify properties of the die-cast products, for example, ductility.

Other aspects and advantages of this invention will be appreciated from the following detailed description.

DETAILED DESCRIPTION OF THE INVENTION

Figure 1:
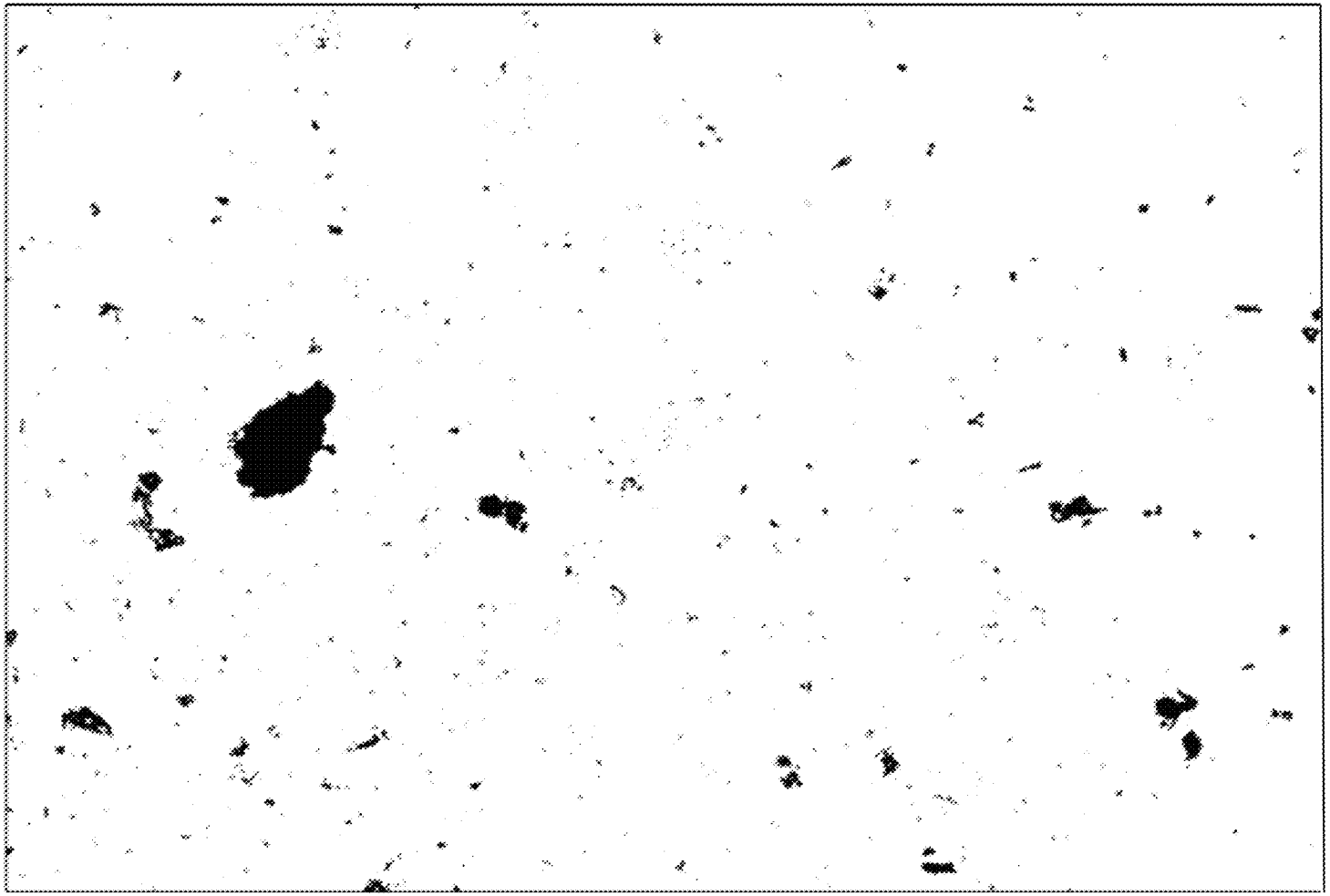
FIG. 1 is an optical image of porosity in a die-cast product produced by die casting using a commercial lubricant.

This disclosure describes lubricant compositions suitable for use in die casting a variety of metals and metal alloys (referred to herein simply as metals), including but not limited to aluminum and its alloys. As such, the term "metal" will be used to describe melts and die-cast products produced therefrom, and encompass melts and products whose compositions may be or at least contain a pure metal or a metal alloy. The lubricant compositions are adapted to be applied to working surfaces of dies prior to die casting, and promote an increase in the wetting of the working surfaces by a melt leading to improved die filling, improved surface finish, and reduced porosity and inclusions in the resulting die-cast product. As a result of reduced inclusions and porosity, die-cast products produced by processes using the lubricant compositions are preferably heat treatable and therefore capable of exhibiting improved mechanical properties suitable for certain applications such as structural applications. A wide variety of known dies and die casting equipment are capable of using lubricant compositions described herein, and therefore will not be described in any detail here.

In one embodiment of this disclosure, a composition for use as a lubricant comprises a carrier fluid and at least one active component. For purposes of this disclosure, the term "active component" refers to an additive of the lubricant composition that is capable of reacting with an oxide of a metal to remove a layer of the oxide that forms on a surface of a melt. In so doing, the active component is capable of promoting one or more properties or outcomes of a die casting operation, as nonlimiting examples, improved die filling by a melt and reduced inclusions and porosity, thereby yielding a die-cast product that may be heat treatable.

The carrier fluid of the lubricant composition may be one or more various lubricants, including known oil-based and water-based die lubricants (die release fluids) conventionally used commercial die casting operations. Such carrier fluids may be a mixture of a liquid and one or more other constituents, for example, an emulsion containing water. Nonlimiting examples include synthetic water-soluble die release fluids commercially available from Cross Chemical Company, Inc., under the name Cast-Rite® AMZ III, which is reported to be suitable for die casting aluminum, magnesium, and zinc.

The active component(s) of the lubricant composition include mixtures of halide salt compounds that, when in contact with a melt, react or interact with one or more oxides of one or more metals of the melt that form during a die casting operation, for example, due to exposure of the melt to oxygen (air). A nonlimiting example is aluminum oxide (alumina, $Al_2O_3$) that forms on aluminum-containing melts during die casting. The active component particularly reacts with an oxide to remove a layer of the oxide that forms on a surface of the melt and/or to reduce the likelihood of formation of an oxide layer on surfaces of the melt. In addition to reducing inclusions of oxides in the resulting die-cast product, removal of an oxide layer reduces the surface tension of the melt to improve fluidity and promote wetting of the die surface by the melt, thereby promoting die filling. As a result, the lubricant composition is capable of reducing porosity and oxide inclusions in die-cast products due to a reduced turbulence of the melt. Porosity and inclusions in die-cast products can be reduced to the extent that the products are heat treatable to achieve improved mechanical properties. For example, die-cast products produced by processes using the lubricant compositions described above may possess improved ductility after heat treatment and hence properties suitable for structural applications, such as engine cradles and steering arms for automobiles (typically made of aluminum alloys).

Preferred active components for the lubricant composition are those capable of melting during the die casting process. Notable examples of active components with these characteristics include mixtures of various fluoride salts, including but not limited to compounds of one or more of the following fluoride compounds: LiF, NaF, $AlF_3$, KF, $TiF_4$, $BF_3$, $ZrF_4$, and $CaF_2$. Particular but nonlimiting examples of such compounds are complex salts such as $KAlF_4$ (a compound of KF and $AlF_3$), $K_2TiF_6$ (a compound of KF and $TiF_4$), and $KBF_4$ (a compound of KB and $BF_3$). Alternatively or in addition, the lubricant composition may contain one or more mixtures containing other halide salts (e.g., bromide compounds and chloride compounds) as active components of the lubricant composition. Active components can be added as solids to the carrier fluid and incorporated into the carrier fluid by stirring to form a suspension or solution. If suspended in the carrier fluid, to reduce the risk of clogging a spray nozzle that may be used to apply the lubricant composition to a working surface of a die, suitable particle sizes for the active components are generally on the order of less than thirty micrometers.

The amount of active component(s) admixed with the carrier fluid may vary depending on the composition of the carrier fluid. A sufficient amount of active component is that which can be experimentally determined to effectively if not entirely remove an oxide layer on an exposed surface of a melt corresponding to a predetermined die size and volume of melt. In practice, it is believed that one or more of the above-identified halide salt compounds can be combined with the carrier fluid in an amount of up to about 1 gram per gallon (about 0.26 gram per liter), for example, about 0.5 to 1 gram per gallon (about 0.13 to 0.26 gram per liter).

In addition to the active components, lubricant compositions of this invention may include other additives that promote various properties of the composition or the resulting die-cast product. For example, a die protector such as inert nanoparticles of $TiB_2$ may also be added to the lubricant composition to protect and extend the life span of a die by inhibiting adhesion of a die-cast product to the working surfaces of the die. The die protector and/or other additives can be mixed with the active component(s) prior to their addition to the carrier fluid, or can be separately admixed into the carrier fluid. As with the active components, the particle sizes of the die protector and any other additives should be sufficiently small such that the particles will not clog a spray nozzle employed to spray the lubricant composition onto working surfaces of the die. Preferred particle sizes for die protector particles such as $TiB_2$ are below 100 nanometers, more preferably a few nanometers.

Figure 2:
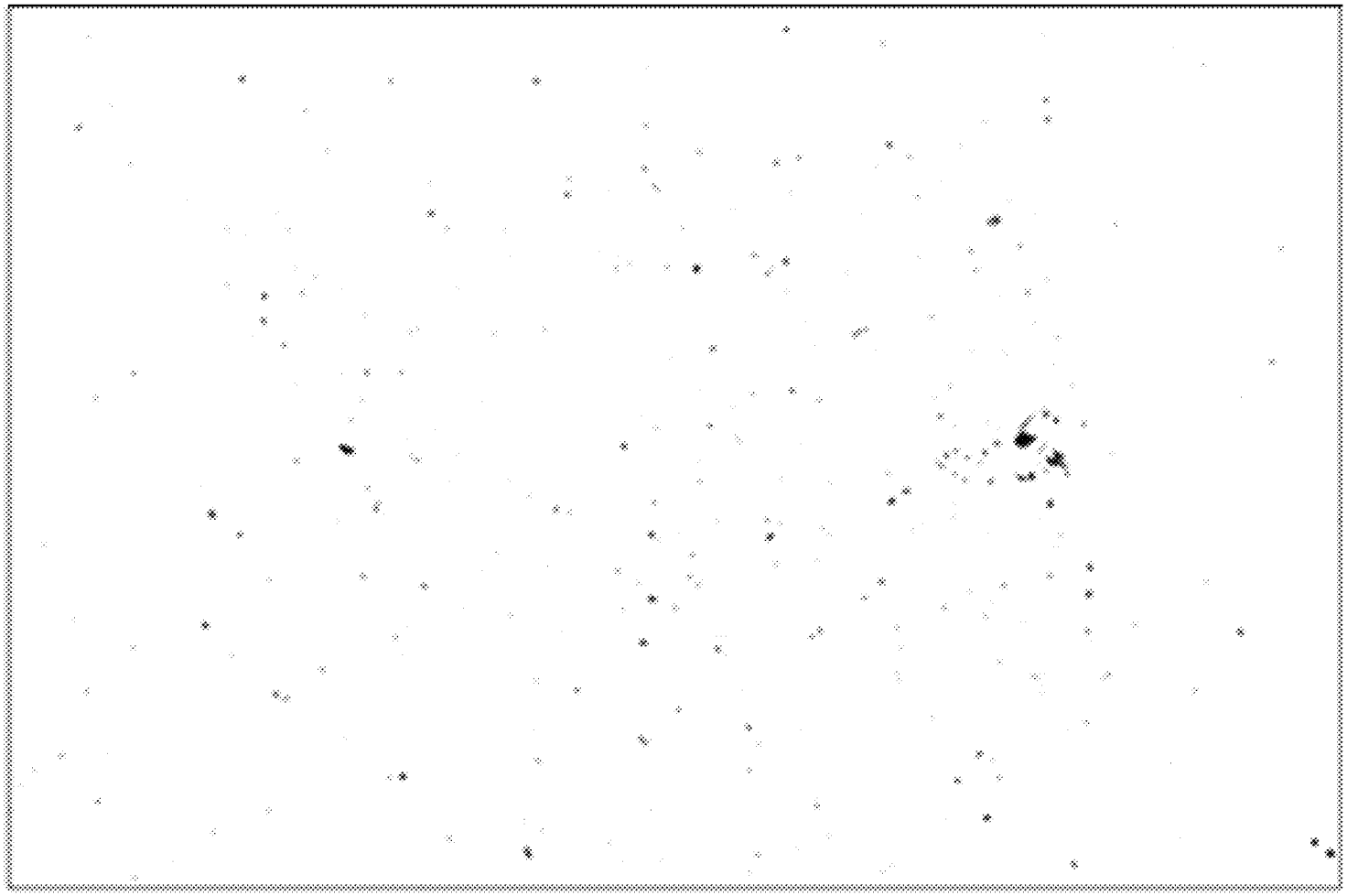
FIG. 2 is an optical image of porosity in a die-cast product produced by die casting using a lubricant composition in accordance with nonlimiting aspects of the invention.

FIGS. 1 and 2 are optical images representing the distribution and shapes of porosity in die-cast products that were produced with similar die casting processes and dies that were pre-coated with either a commercial lubricant or a lubricant composition containing a mixture of halide salts as an active component. As shown, porosity size was significantly reduced in the die-cast product produced using the lubricant composition containing the active component.

In view of the foregoing, a method of producing a die-cast product with the use of a lubricant composition as described herein generally entails providing a die suitable for casting a product of a particular metal composition of interest, coating interior die cavity surfaces of the die with the lubricant composition, injecting a molten quantity (melt) of the metal composition into the die cavity such that the melt contacts working surfaces of the die and the active component reacts with an oxide of a metal of the metal composition to remove a layer of the oxide that forms on a surface of the melt, and solidifying the melt in the die to produce a die-cast product. Various metal compositions may be cast using this process, particular but nonlimiting examples of which are aluminum and its alloys.

As previously described, die-cast products produced by methods described herein are preferably capable of exhibiting sufficiently low levels of inclusions and/or porosity to render the products suitable for heat treatments to achieve desired mechanical properties, such as but not limited to increased ductility. Suitable heat treatments include, but are not limited to, age hardening treatments.

In view of the foregoing, advantages of using a lubricant composition of a type as described above in a die casting process may include one or more of the following: an extended die service life due to reduced injection temperatures, a reduction in the force/pressure required for die filling, reduced porosity and inclusions in the resulting die-cast products, products that are heat treatable, and die-cast products that exhibit relatively high ductility, such as but not limited to die-cast aluminum parts suitable for structural applications.

While the invention has been described in terms of specific embodiments, it is apparent that other forms could be adopted by one skilled in the art. For example, the constituents and their amounts in the lubricant composition may vary depending, for example, on the constituents and the intended application, and materials and processes/methods other than those noted could be used. In addition, the invention encompasses additional embodiments in which one or more features or aspects of different disclosed embodiments may be eliminated or combined. Therefore, the scope of the invention is to be limited only by the following claims.

The invention claimed is:

1. A lubricant composition for coating working surfaces of a die that are contacted with a melt containing a molten metal during a die casting process, the lubricant composition comprising:

a carrier fluid; and at least one active component that reacts with an oxide of the metal to remove a layer of the oxide that forms on a surface of the melt, wherein the carrier fluid is a die lubricant; and the at least one active component is a complex salt comprising one or more of $K_2TiF_6$ and $KBF_4$.

2. The lubricant composition of claim 1, wherein the at least one active component is a solid suspended in the carrier fluid.

3. The lubricant composition of claim 2, wherein the at least one active component has a particle size of less than thirty micrometers.

4. The lubricant composition of claim 1, wherein the at least one active component is combined with the carrier fluid in an amount of up to 0.26 gram per liter.

5. The lubricant composition of claim 1, wherein the at least one active component is combined with the carrier fluid in an amount of 0.13 to 0.26 gram per liter.

6. The lubricant composition of claim 1, further comprising a die protector that inhibits adhesion of a die-cast product to the working surfaces of the die.

7. The lubricant composition of claim 6, wherein the die protector comprises nanoparticles of $TiB_2$.

8. A method of producing a die-cast product, the method comprising:

providing a die for casting a melt containing a molten metal;

coating working surfaces of the die with the lubricant composition of claim 1;

injecting a quantity of the melt into the die such that the melt contacts the working surfaces and the at least one active component reacts with an oxide of the metal to remove a layer of the oxide that forms on a surface of the melt; and solidifying the melt in the die to yield the die-cast product.

9. The method of claim 8, further comprising producing the lubricant composition to include the at least one active component in the carrier fluid.

10. The method of claim 9, wherein the at least one active component is a solid suspended in the carrier fluid.

11. The method of claim 10, wherein the at least one active component has a particle size of less than thirty micrometers.

12. The method of claim 8, wherein the lubricant composition comprises a die protector that inhibits adhesion of the die-cast product to the working surfaces of the die.

13. The method of claim 8, further comprising performing a heat treatment on the die-cast product to increase ductility thereof.

14. The method of claim 8, wherein the metal is aluminum or an aluminum alloy and the die-cast product is formed of aluminum or an aluminum alloy.

* * * * *